US010786025B2

(12) United States Patent
Toba

(10) Patent No.: US 10,786,025 B2
(45) Date of Patent: Sep. 29, 2020

(54) WIG BASE AND WIG

(71) Applicant: Aderans Company Limited, Tokyo (JP)

(72) Inventor: Mayumi Toba, Tokyo (JP)

(73) Assignee: ADERANS COMPANY LIMITED, Tokyo (JP)

( * ) Notice: Subject to any disclaimer, the term of this patent is extended or adjusted under 35 U.S.C. 154(b) by 234 days.

(21) Appl. No.: 15/570,446

(22) PCT Filed: Apr. 26, 2016

(86) PCT No.: PCT/JP2016/063043

§ 371 (c)(1),
(2) Date: Oct. 30, 2017

(87) PCT Pub. No.: WO2016/178389

PCT Pub. Date: Nov. 10, 2016

(65) Prior Publication Data

US 2018/0146731 A1 May 31, 2018

(30) Foreign Application Priority Data

May 1, 2015 (JP) ..... 2015-094306

(51) Int. Cl.
*A41G 3/00* (2006.01)

(52) U.S. Cl.
CPC ..... *A41G 3/0041* (2013.01); *A41G 3/0008* (2013.01)

(58) Field of Classification Search
CPC ..... A41G 5/006; A41G 5/004; A41G 5/0046; A41G 5/0053; A41G 5/0066;
(Continued)

(56) References Cited

U.S. PATENT DOCUMENTS 41,465 A * 2/1864 Smyth ..... A45D 8/40 132/274
1,848,993 A * 3/1932 Butcher ..... A45D 8/40 132/274

(Continued)

FOREIGN PATENT DOCUMENTS

JP 5-2567 1/1993
JP 11-107024 4/1999

(Continued)

OTHER PUBLICATIONS

International Search Report dated Aug. 9, 2016 in International (PCT) Application No. PCT/JP2016/063043.

*Primary Examiner* — Rachel R Steitz
*Assistant Examiner* — Brianne E Kalach
(74) *Attorney, Agent, or Firm* — Wenderoth, Lind & Ponack, L.L.P.

(57) ABSTRACT

A wig base having a surface portion to which artificial hairs will be planted, an outer frame in which a first string shaped member to which artificial hairs will be planted is placed apart from at least a part of the surface portion, a middle portion in which a second string shaped member to which artificial hairs will be planted is placed in a waveform having apexes located at the surface portion side and at the outer frame side between the surface portion and the outer frame, wherein apexes of the wave-formed second string shaped member at the surface portion side and the surface portion are fixed together, wherein at least at the apexes of the second string shaped member at the outer frame side, the first and second string shaped members are connected such that a relative position of the first and second string shaped members may change.

13 Claims, 16 Drawing Sheets

(58) Field of Classification Search
CPC .... A41G 3/0016; A41G 3/0041; A41G 3/005; A41G 3/0058; A41G 3/0066; A45D 8/40; A45D 44/22
See application file for complete search history.

(56) References Cited

U.S. PATENT DOCUMENTS

| | | | | | |
|---|---|---|---|---|---|
| 2,453,043 | A * | 11/1948 | Solomon | A45D 8/40 | 87/2 |
| 3,094,995 | A * | 6/1963 | Dietze | A45D 8/40 | 132/274 |
| 3,834,403 | A * | 9/1974 | Ahn | A41G 3/0041 | 132/53 |
| 6,257,244 | B1 * | 7/2001 | Williams | A41G 3/0016 | 132/53 |
| 8,813,761 | B2 * | 8/2014 | Guliker | A41G 5/006 | 132/53 |
| 2010/0236563 | A1 | 9/2010 | Kimura et al. | | |

FOREIGN PATENT DOCUMENTS

| | | |
|---|---|---|
| JP | 2004-68196 | 3/2004 |
| JP | 2006-70392 | 3/2006 |
| JP | 2008-57078 | 3/2008 |
| JP | 2006-70391 | 3/2016 |

* cited by examiner

WIG BASE AND WIG

FIELD OF INVENTION

The present invention relates to a wig base and a wig to which artificial hairs are planted.

BACKGROUND OF THE ART

A wig attached to the head of a wearer is generally formed by planting artificial hairs to a base part so called a wig base. In such wigs, there is proposed a wig which has a portion to which artificial hairs are planted in high density and a portion to which artificial hairs are planted in lower density according to a growing state of own hairs of a wearer, and in which the own hairs may be pulled out of the portion to which artificial hairs are planted in lower density (Refer to Patent Document 1).

Patent Document 1: JP2006-70392A

SUMMARY OF INVENTION

Problem to be Solved

The wig described in Patent Document 1 includes a shielding portion formed by a net with a fine mesh and an adjusting portion formed by a net with a rough mesh. In the shielding portion, artificial hairs are planted in high density, and in the adjusting portion, artificial hairs are planted in lower density than the shielding portion. Own hairs may be pulled out of an opening of the rough mesh of the adjusting portion, and thereby obtaining a natural appearance in which own hairs and artificial hairs are mixed together.

However, since the opening of the mesh of the adjusting portion described in Patent Document 1 is not large, it is difficult to pull own hairs out of the opening on the condition that the wig is attached to the head. Further, since the opening of the mesh has a corner, it is difficult to achieve a smooth hair flow, and to have a condition such that artificial hairs planted close to the corner of the mesh and own hairs are mixed together naturally.

Further, since a hair-utilizing portion has a special shape in which a pitch of the mesh varies according to the location, a manufacturing cost of the wig base tends to be raised. Once the special shape whose pitch of the mesh varies is determined, it is difficult to change this special shape. Therefore, it is difficult to have many variations according to a growing state of own hairs of a wearer, applications or the like.

An object of one aspect of the present invention is to solve the above-mentioned problems, and to provide at a low manufacturing cost, a wig base and a wig which may easily have many variations according to a growing state of own hairs of a wearer, applications or the like, in which own hairs may be pulled out easily, and which have a natural and beautiful hair flow, and which may achieve an appearance in which artificial hairs and own hairs are mixed naturally, in a portion of which own hairs may be pulled out.

Means for Solving Problem

In order to solve the above-mentioned problem, a wig base according to one aspect of the present invention comprises: a surface portion having a surface to which artificial hairs may be planted, an outer frame portion in which a first string shaped member to which artificial hairs will be planted is placed outside apart from the surface portion, a middle portion in which a second string shaped member to which artificial hairs will be planted is placed in a waveform between the surface portion and the outer frame portion which are apart from each other, and the surface portion and the outer frame portion are connected via the middle portion.

A wig according to one aspect of the present invention is formed by planting artificial hairs to the above-mentioned wig base.

Effect of Invention

According to the above-mentioned aspects of the present invention, it may provide at a low manufacturing cost, the wig base and the wig, of which own hairs may be pulled out easily, which have a natural and beautiful hair flow, which may achieve an appearance in which artificial hairs and own hairs are mixed naturally, and which may easily have many variations according to a growing state of own hairs of a wearer, applications or the like, in a portion of which own hairs may be pulled out.

DESCRIPTION OF EMBODIMENT

Figure 1:
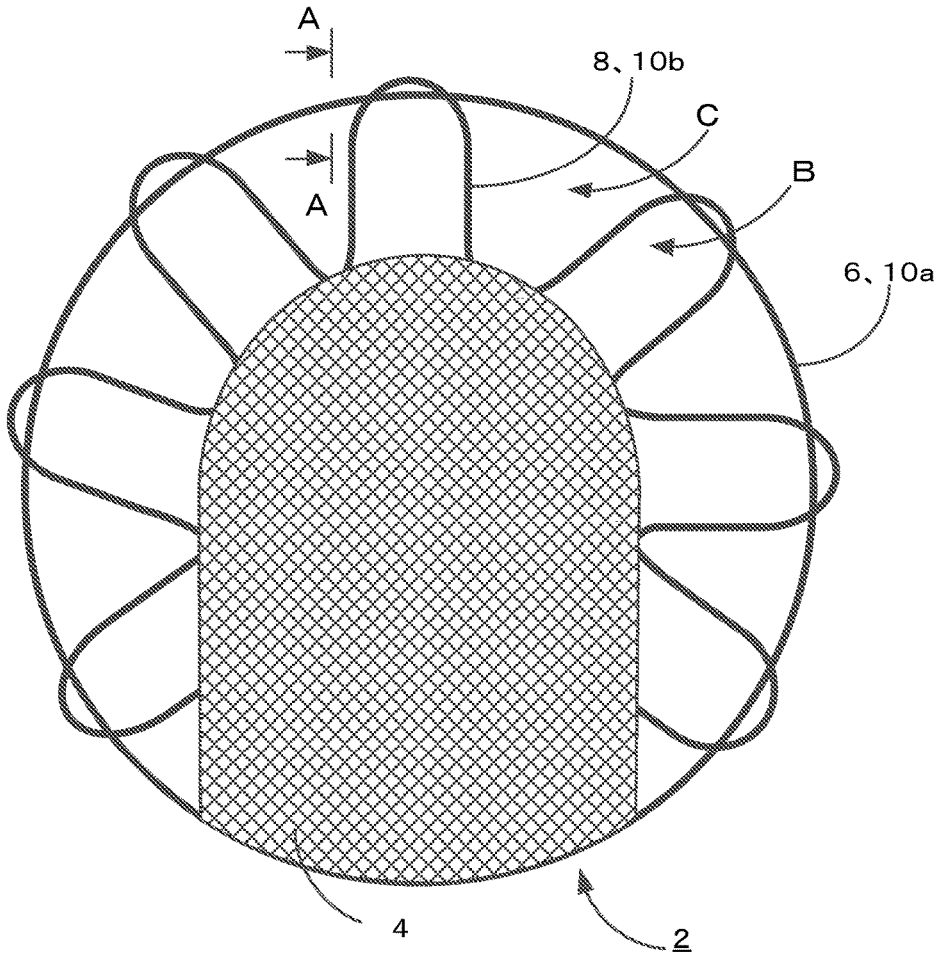
FIG. 1 is a plan view for illustrating a wig base according to one embodiment of the present invention.

A wig base according to Aspect 1 of the present invention comprises:

a surface portion having a surface to which artificial hairs may be planted, an outer frame portion in which a first string shaped member to which artificial hairs will be planted is placed outside apart from the surface portion, a middle portion in which a second string shaped member to which artificial hairs will be planted is placed in a waveform between the surface portion and the outer frame portion which are apart from each other, and the surface portion and the outer frame portion are connected together via the middle portion.

A state of "connected together" includes both a state of "fixed by sewing, by adhesive agents or the like" and a state of "connected in the manner such that a relative position thereof may change".

A term of "to which artificial hairs may be planted" means that artificial hairs formed by natural hairs or manmade hairs made from synthetic fibers may be planted. In the case, any known planting means for artificial hairs may be applied. For example, artificial hairs may be planted by tying the artificial hairs to a surface having a net shape or a meshwork shape, by adhering the artificial hairs to a sheet shaped member such as an artificial skin made of resin by using coating agents, or by tying the artificial hairs to a hole made on a sheet shaped member.

The "outer frame portion in which the first string shaped member is placed outside apart from the surface portion" includes both one in which the first string shaped member is formed in a circular shape, surrounding a periphery of the surface portion (apart from the surface portion), and one in which a part of such circle is formed by the first string shaped member and both ends of the first string shaped member are connected to the surface portion. While it is preferable that the outer frame portion is formed by a smooth curve, there is also a case that the outer frame portion is formed by a straight part or a curve with a small curvature radius according to applications.

As the "waveform formed and placed between the surface portion and the outer frame portion", it is exemplified that the second string shaped portion goes zigzag between the surface portion and the outer frame portion around the surface portion. While the waveform is preferably formed by a curve, there is also a case that the waveform is formed by a straight part or a curve with a small curvature radius according to applications.

In a wig formed by planting artificial hairs to the wig base according to this embodiment, since artificial hairs are planted to the surface portion in high density and artificial hairs are planted only to the string shaped member in the middle portion placed located adjacent to the surface portion, artificial hairs are planted to the middle portion in lower density than the surface portion. In a case of attaching such wig to the head of a wearer, the surface portion to which artificial hairs are planted in higher density may be placed to a portion of the head having less own hairs, and therefore own hairs may be pulled out of the space between the string shaped members in the middle portion. Accordingly, it may place artificial hairs planted to the string shaped member and own hairs with mixing them together, and hold the wig to the head by own hairs to be pulled out.

Especially, in the middle portion of which own hairs may be pulled out, since the second string shaped member is placed in a waveform between the surface portion and the outer frame portion, for example, a wide space may be secured at the bottom side of the waveform, and thereby pulling out own hairs easily. Further, since the waveform is formed by a smooth curve, it may obtain a natural and beautiful hair flow and achieve an appearance that artificial hairs and own hairs are mixed naturally.

Further, since the middle portion may be formed by placing one piece of the second string shaped member in a waveform, for example, many variations may easily be obtained according to a growing state of own hairs, applications or the like by changing a pitch or the like of the waveform. In this case, since it is not necessary to make a member having a specific shape, it may reduce a manufacturing cost of the wig base.

In the wig base according to Aspect 2 of the present invention, according to the above Aspect 1, at least at a part of connecting parts between the first string shaped member of the outer frame portion and the second string shaped member of the middle portion, they are connected in the manner such that a relative position thereof may change.

The "at least at a part of connecting parts between the first string shaped member of the outer frame portion and the second string shaped member of the middle portion, they are connected in the manner such that a relative position thereof may change" includes both "connected at all the connecting parts in the manner such that a relative position thereof may change" and "connected at a part of the connecting parts in the manner such that a relative position thereof may change". In the latter case, it is possible that the first string shaped member and the second string shaped member are fixed together at a part of the connected parts.

As a connecting means such that at the connecting part of the first string shaped member of the outer frame portion and the second string shaped member of the middle portion, a relative position thereof may change, any means including ones described later may be utilized.

In this aspect, since the first string shaped member of the outer frame portion and the second string shaped member of the middle portion connect in the manner such that a relative position thereof may change at the connecting parts thereof, a position of the string shaped member may be changed in the middle portion, according to a growing condition of own hairs, applications or the like. Accordingly it may provide the wig base which is applicable to a wide range of wearers and various applications.

Relating to a change of the position of the string shaped member, not only a position of the second string shaped member but also a corresponding position of the first string shaped member may change.

In the wig base according to Aspect 3 of the present invention, according to the above Aspect 1 or 2, the first string shaped member of the outer frame portion is placed inside the apexes of the waveform located outside formed by the second string shaped member.

In this Aspect, since the first string shaped member of the outer frame portion is placed inside the apexes of the waveform located outside formed by the second string shaped member, it may surely achieve, with a simple construction, connection in the manner such that a relative position thereof may change at the connecting part between the first string shaped member of the outer frame portion and the second sting shaped member of the middle portion.

In the wig base according to Aspect 4 of the present invention, according to any one of the above Aspects 1 to 3, the first string shaped member and the second string shaped member are flexible and may hold a deformed shape.

According to this Aspect, since the first string shaped member and the second string shaped member are flexible and may hold a deformed shape, a position of the string shaped member may be changed according to a growing condition of own hairs, applications or the like and further such condition may be held. Accordingly, it may provide the wig base which a wide range of wearers may use for various applications at ease.

In the wig base according to Aspect 5 of the present invention, according to the above Aspect 4, the first string shaped member and the second string shaped member are formed in a hollow cylindrical shape, and a core member which is flexible and may hold a deformed shape is inserted inside the hollow cylindrical shape.

According to this Aspect, since the first string shaped member and the second string shaped member are formed in a hollow cylindrical shape, and a core member which is flexible and may hold a deformed shape is inserted inside the hollow cylindrical shape, it may easily and surely provide the string shaped member which is flexible and may hold a deformed shape.

Relating to the first string shaped member and the second string shaped member, a means for obtaining flexibility and capability to hold a deformed shape is not limited to the above Aspect, but any other means may be applied. For example, when the first string shaped member and the second string shaped member are formed by winding up a sheet member into a cylindrical shape, it may achieve by using a material which is flexible and may hold a deformed shape for the sheet member. Further, it is possible to add flexibility and capability to hold a deformed shape to the first string shaped member and the second string shaped member by forming an elongated sheet member or a string shaped member which have flexibility and capability to hold a deformed shape into a spiral shape. In this case, artificial hairs may be tied and planted to the spiral shaped part thereof.

In the wig base according to Aspect 6 of the present invention, according to any one of the above Aspects 1 to 5, artificial hairs may be planted to any place of the surface in a circumference direction of the first string shaped member and the second string shaped member.

According to this Aspect, since artificial hairs may be planted to any place of the surface in a circumference direction of the string shaped member, it may achieve an appropriate arrangement of artificial hairs which may have a natural appearance of hairs according to a growing condition of own hairs of a wearer, applications or the like. Thus, it may achieve a natural and beautiful hair flow without causing any sense of discomfort to the mixed own hairs.

In the wig base according to Aspect 7 of the present invention, according to any one of the above Aspects 1 to 6, the surface portion, the first string shaped member and the second string shaped portion have a net shaped surface or a meshwork shape.

Both the "net shaped" and the "meshwork shaped" mean having a shape by tying a thread shaped member or a string shaped member into a latticed pattern. The "meshwork shaped" has rougher mesh than the "net shaped".

According to this Aspect, since the surface portion, the first string shaped member and the second string shaped portion have a net shaped surface or a meshwork shape surface, artificial hairs may be wound around a frame member (filament) of the net or the meshwork and tied and fixed thereto. Accordingly, artificial hairs may surely be planted to the surface portion and the string shaped members. Further, since it brings air permeability, it may prevent the head from being sweaty while wearing the wig.

In the wig base according to Aspect 8 of the present invention, according to any one of the above Aspects 1 to 7, the second string shaped member which forms the middle portion and the surface portion are fixed together.

According to this Aspect, since the second string shaped member which forms the middle portion and the surface portion are fixed together, it may provide the wig base having a practically sufficient strength.

In a wig according to Aspect 9 of the present invention, artificial hairs are planted to the wig base according to any one of the above Aspects 1 to 8.

According to this Aspect, the same effect as the above Aspects 1 to 8 may be obtained. Especially, by pulling out own hairs toward a space at the middle portion, artificial hairs and own hairs are mixed together, and thereby being indistinguishable. Accordingly, it may reduce a sense of discomfort between artificial hairs and own hairs, and thereby obtaining more natural appearance. Further, since the wig may be fixed to the head more steadily by pulling out own hairs toward the space at the middle portion, it may reduce a risk that the wig moves over or slides off.

In the wig according to Aspect 10 of the present invention, according to the above Aspect 9, a same artificial hair is planted to the first string shaped member and the second string shaped member, and thereby fixing the middle portion and the outer frame portion together.

According to this Aspect, since the middle portion and the outer frame portion may be fixed together by planting the same artificial hairs, the middle portion and the outer frame portion may be fixed together efficiently without using surplus connecting members or the like.

Next, a wig base according to embodiments of the present invention and a wig using this wig base will be described with referring to the attached drawings.

(General Description of Wig Base)

A wig base is a main member which forms a wig, and the wig is formed by planting artificial hairs formed by natural hairs, manmade hairs or the like to the wig base. A surface of the side to which no artificial hair is planted becomes a mounting surface which contacts the head.

Figure 2:
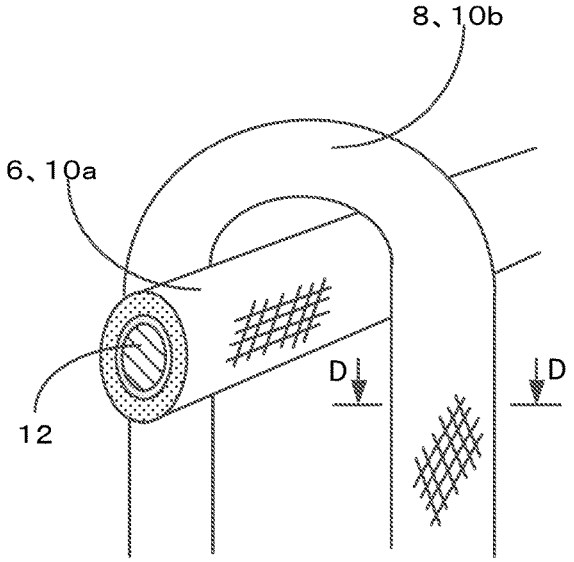
FIG. 2(*a*) is a perspective view seen from the arrow A of FIG. 1, and FIG. 2(*b*) is a sectional view seen from the arrow D in FIG. 2(*a*), for illustrating a construction of a connecting part of a first string shaped member of an outer frame portion and a second string shaped member of a middle portion according to one embodiment.
Figure 2B:
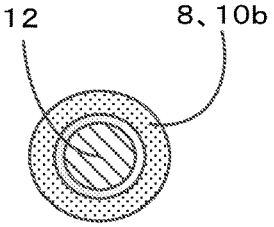

Firstly, a wig base according to one embodiment of the present invention is described with referring to FIG. 1 and FIG. 2. FIG. 1 is a plan view for illustrating a wig base 2 according to the one embodiment of the present invention. FIG. 2 is a perspective view and a partial sectional view seen from the arrow A of FIG. 1, for illustrating a construction of a connecting part of a first string shaped member 10*a* of an outer frame portion 6 and a second string shaped member 10*b* of a middle portion 8. Further, the drawing illustrates partially a sectional view of the first string shaped member 10*a* (refer to FIG. 2 (*a*)), and a sectional view of the second string shaped member 10*b* (refer to FIG. 2 (*b*)).

As illustrated in FIG. 1, the wig base 2 according to this embodiment includes a surface portion 4 having a surface to which artificial hairs may be planted, an outer frame portion 6 in which a first string shaped member 10*a* to which artificial hairs may be planted is placed outside apart from the surface portion 4, a middle portion 8 in which a second string shaped member 10*b* to which artificial hairs may be planted is placed in a waveform between the surface portion 4 and the outer frame portion 6 which are apart from each other. The surface portion 4 and the outer frame portion 6 are connected together via the middle portion 8.

A state of "connected together" includes both a state of "fixed by sewing, by adhesive agents or the like" and a state of "connected in the manner such that a relative position may change". A term of "to which artificial hairs may be planted" means that artificial hairs formed by natural hairs or manmade hairs made from synthetic fibers may be planted.

As illustrated in FIG. 1, the surface portion 4 according to this embodiment is formed by a net shaped material made from a resin material or a natural material. The surface portion 4 has a net shaped surface, and artificial hairs may be planted to the surface portion 4 by inserting the artificial hairs into an opening of the mesh of the net, tying the artificial hairs to a frame member (filament) of the mesh. In this embodiment, the surface portion 4 is formed by piling two sheets of the net shaped material and sewing around a periphery thereof. Since this configuration brings air permeability, it may prevent the head from being sweaty while wearing the wig. Further, the surface portion 4 may have a strength enough for a wig base by piling two sheets of the net shaped material. By placing a knotted part of the artificial hair between the two sheets of the net shaped material, it may prevent artificial hairs from being dropped off or being damaged. Further, it may prevent a problem such that the knotted part of artificial hairs hits the head while wearing the wig.

The surface portion 4 according to the embodiment is not limited thereto. It is sufficient if it has a net shaped surface at least on the side to which artificial hairs are planted, and a sheet or cloth may be placed between the two sheets of the net shaped material.

On the contrary, as illustrated in FIG. 2 (*a*) which is a perspective view seen from the arrow A of FIG. 1, the first string shaped member 10*a* is formed by a net shaped material in a hollow cylindrical shape, and has a net shaped surface. As illustrated in FIG. 2 (*b*) which is a sectional view seen from the arrow D in FIG. 2 (*a*), the second string shaped member 10*b* is also formed by a net shaped material in a hollow cylindrical shape, and has a net shaped surface.

Relating to a way to form a net shaped material into a cylindrical shape, in a case of forming by a resin material or the like, it may be integrally molded using metallic molds. It may also be formed by winding up a sheet of a net shaped material made from a resin material or a natural material into a cylindrical shape, and then connecting both ends thereof by welding, or sewing. Artificial hairs may be planted to the net shaped material in the cylindrical shape by inserting the artificial hairs into an opening of the mesh of the net, tying the artificial hairs to a frame member (filament) of the mesh. As a material for the first string shaped member 10*a* and the second string shaped amber 10*b*, one with the same material and construction may be used as well as one with different material and shape may be used. For example, it may be considered that net shape materials having different pitch of the mesh are used for the first string shaped member 10*a* and the second string shaped member 10*b* respectively.

Similarly, as a material for the surface portion 4 and the string shaped members 10*a*, 10*b*, both a net shape material having the same pitch of the mesh and net shape materials having different pitch of the mesh may be used.

In the above-mentioned embodiment, while both the surface portion 4 and the string shaped members 10*a*, 10*b* have a net shaped surface, they are not limited thereto, and they may have a meshwork shaped surface having a rougher mesh according to applications.

As mentioned above, since the surface portion 4, and the string shaped members 10*a*, 10*b* have the net shaped surface or the meshwork shape, artificial hairs may be wound around the frame member (filament) of the net or the meshwork and tied and fixed thereto. Accordingly, artificial hairs may surely be planted to the wig base. Further, since it brings air permeability, it may prevent the head from being sweaty while wearing the wig.

The surface portion 4 and the string shaped members 10*a*, 10*b* may have not only the net shaped or the meshwork shaped surface but also a sheet shaped member without holes such as an artificial skin or the like. It is possible to plant artificial hairs to the surface portion 4, the first string shaped member 10*a* and the second string shaped portion 10*b* using any known planting method of artificial hairs. Further detailed explanation will be described later. A wig may be formed by planting artificial hairs to one surface of the surface portion 4, the first string shaped portion 10*a* forming the outer frame portion 6 and the second string shaped member 10*b* forming the middle portion 8.

Figure 11:
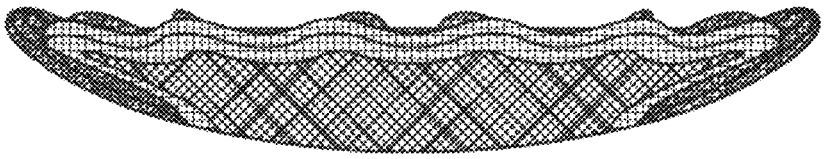
FIG. 11 is a plan view for illustrating a wig base according to Example 1 of the present invention.

The shape of the surface portion 4 illustrated in FIG. 11 is an only example, and a surface portion 4 having any size and any shape may be applied according to a growing condition of own hairs of a wearer.

As illustrated in FIG. 1, in the outer frame portion 6, a part of a ring is formed by the first string shaped member 10*a*, and such part of the ring is placed outside apart from the surface portion 4, and both ends of the first string shaped member 10*a* is fixed to the surface portion 4. The outer frame portion 6 is formed by a smooth curve. The outer frame portion 6 defines the outline of wig base, and adds a certain mechanical strength to the wig base.

A shape of the outer frame portion 6 is not limited thereto. For example, it is possible that a ring is formed by the first string shaped member 10*a* and such ring is placed as surrounds a whole periphery of the surface portion 4 (apart therefrom).

As illustrated in FIG. 1, in the middle portion 8, the second string shaped portion 10*b* is placed as going zigzag between the surface portion 4 and the outer frame portion 6 around the surface portion 4, and thereby forming a waveform in which the second string shaped member 10*b* is placed between the surface port ion 4 and the outer frame portion 6. Accordingly, the middle portion 8 is formed by the waveform having seven apexes located outside formed by a smooth curve. While the waveform having seven apexes located outside is formed in the embodiment as illustrated in FIG. 1, it is not limited thereto, and the waveform having any number of apexes may be utilized.

Figure 3:
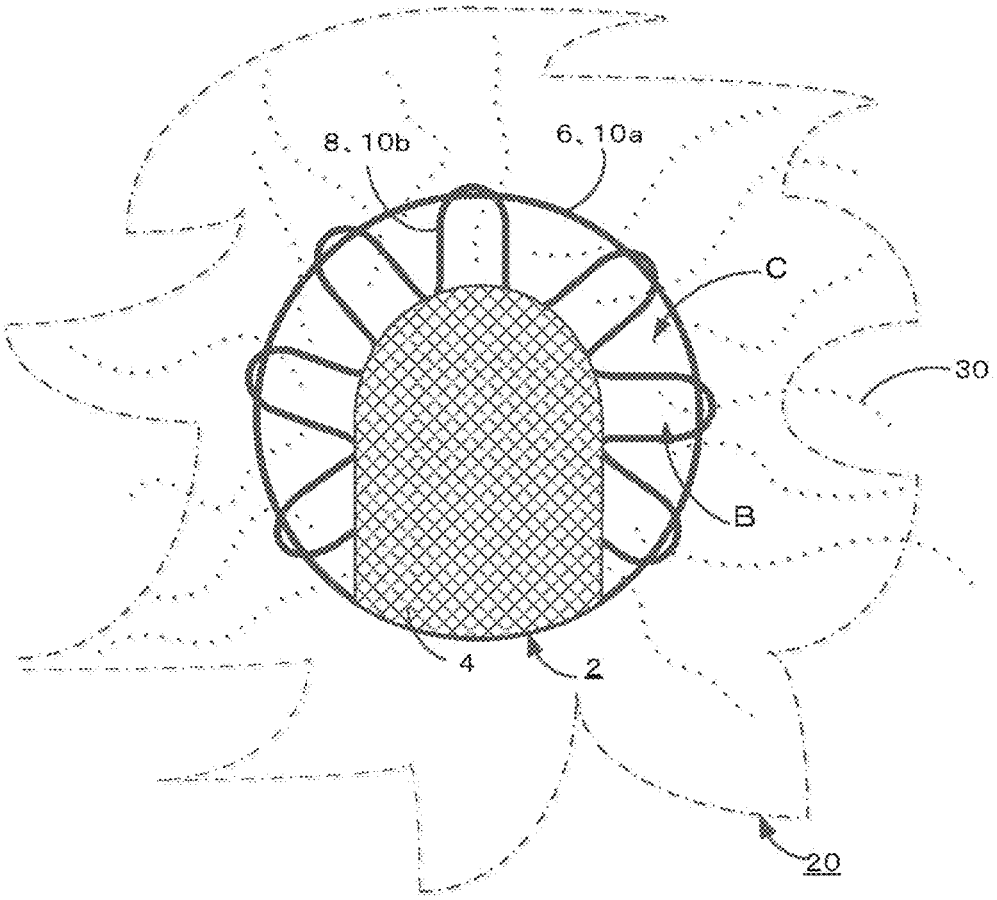
FIG. 3 is a plan view for illustrating a wig base according to one embodiment of the present invention.
Figure 4:
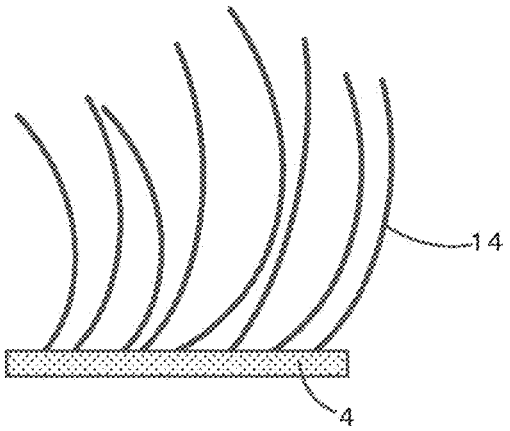
FIG. 4 is a side view for illustrating a state that artificial hairs are planted to the surface portion of the wig as illustrated in FIG. 3.
Figure 5:
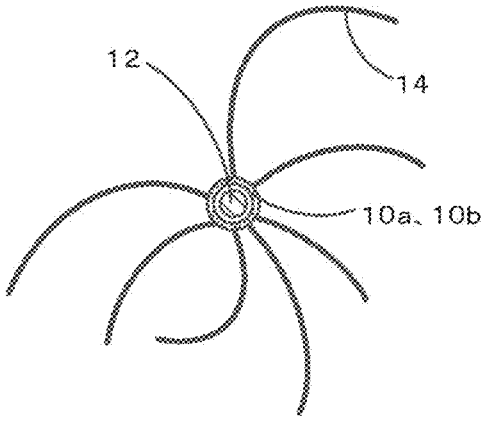
FIG. 5 is a sectional view for illustrating a state that artificial hairs are planted to the first string shaped member and the second string shaped member of the wig as illustrated in FIG. 3.

FIG. 3 illustrates a wig 20 formed by planting artificial hairs to the wig base illustrated in FIG. 1. An outline of the wig to which the artificial hairs are planted is schematically illustrated by the one dot chain line. FIG. 4 is a side view for illustrating a state that artificial hairs 14 are planted to the surface portion 4. FIG. 5 is a sectional view for illustrating a state that artificial hairs 14 are planted to the string shaped members 10*a*, 10*b*.

In the wig illustrated in FIG. 3 to FIG. 5, density of artificial hairs planted to the middle portion 8 is lower than that of surface portion 4 because artificial hairs are planted to the surface portion 4 in high density, and artificial hairs are planted only to the first string shaped member 10*a* and the second string shaped member 10*b* in the outer frame portion 6 and the middle portion 8.

When a wearer attaches the wig 20 to the head, as illustrated from FIG. 3 to FIG. 5, the wearer places the surface portion 4 to which artificial hairs 14 are planted in high density to the area of the head having a few own hairs. In this case, in the middle portion 8 located adjacent to the surface portion 4, own hairs of the wearer may be pulled out using the spaces of the waveform formed in the apexes located outside shown by an arrow B of FIGS. 1 and 3, and spaces of the waveform formed in the apexes located inside shown by an arrow C, between the surface portion 4 and the outer frame portion 6.

Therefore, the artificial hairs 14 planted to the second string shaped member 10*b* (in some case, also the first string shaped member 10*a*) and the own hairs 30 of the wearer may be placed with mixing together. Accordingly, it may reduce a sense of discomfort between the artificial hairs 14 and the own hairs 30 as well as it may hold the wig 20 attached to the head steadily by the own hairs 30 being pulled out.

The spaces shown by the arrow B is further described in detail. They are spaces located at seven places, which are surrounded by the waveform having the apexes located outside formed by the second string shaped members 10*b*, the surface portion 4 and the outer frame portion 6 formed by the first string shaped member 10*a*. The spaces shown by the arrow C is further described in detail. They are spaces located at eight places, which are surrounded by the waveform having the apexes located inside formed by the second string shaped members 10*b* (partially in both ends), the surface portion 4 and the outer frame portion 6 formed by the first string shaped member 10*a*.

In this embodiment, especially, since the second string shaped member 10*b* is placed in the waveform between the surface portion 4 and the outer frame portion 6 in the middle portion 8 of which the own hairs 30 may be pulled out, for example, a wide space may be secured at the bottom side of the waveform, and thereby pulling out the own hairs easily.

After the own hairs are pulled out, the own hairs may be moved toward to the top side of waveform for adjustment. Further, in the case that the second string shaped member 10*b* may be deformed, it is possible to widen the space of the waveform formed by the second string shaped member 10*b* for pulling out the own hairs easily, and further, it is also possible to apply the waveform in which the bottom side is tighten and the middle side is widen.

As illustrated in FIG. 1, the waveform is formed by a smooth curve in the middle portion 8, it may obtain a natural and beautiful hair flow, and achieve an appearance that artificial hairs 14 and own hairs 30 are mixed naturally.

Further, since the middle portion 8 may be formed only by placing one piece of the second string shaped member 10*b* in the waveform, for example, it may obtain many variations easily according to a growing condition of own hairs of a wearer, applications or the like by changing a pitch of the waveform or the like.

Further, since it is not necessary to make a member having a specific shape, a manufacturing cost of the wig base 2 and the wig 20 may be reduced.

(Detail Description of Wig Base)

The wig base 2 according to this embodiment is described in detail. As illustrated in FIG. 2 (*a*) which is a perspective view seen from the arrow A of FIG. 1, the first string shaped member 10*a* of the outer frame portion 6 is placed inside the apexes of the waveform located outside formed by the second string shaped member 10*b*, thus inside the apexes of the waveform of the string shaped member 10*b* at the periphery side.

Accordingly, since at the connection part between the first string shaped member 10*a* of the outer frame portion 8 and the second string shaped member 10*b* of the middle portion 6, they are connected each other in the manner such that a relative position thereof may change, a position of the second string shaped member 10*b* may change in the middle portion 8 according to a growing condition of own hairs of a wearer, and in some cases, a position of the first string shaped member 10*a* may change in the outer frame portion 6. Accordingly, it may correspond to a growing state of own hairs of a wearer, applications or the like, especially, it may provide the wig base 2 and wig 20 which may correspond to a wide range of wearers and various applications.

Especially, in this embodiment, as illustrated in FIG. 2 (*a*), since the first string shaped member 10*a* of the outer frame portion 6 is placed inside the apexes of the waveform located outside formed by the second string shaped member 10*b*, it may achieve the connecting part in which a relative position thereof may surely change with a simple construction.

In the above-mentioned embodiment, while in the all connecting parts between the first string shaped member 10*a* of the outer frame portion 6 and the second string shaped member 10*b* of the middle portion 8, a relative position thereof may change, it is not limited thereto. It is also possible that in a part of the connecting parts between the first string shaped member 10*a* of the outer frame portion 6 and the second string shaped member 10*b* of the middle portion 8, a relative position thereof may change, and in the other part of the connection parts, the first string shaped member 10*a* and the second string shaped member 10*b* are fixed together.

At the connecting parts between the first string shaped member 10*a* of the outer frame portion 6 and the second string shaped member 10*b* of the middle portion 8, a means for connecting in the manner such that a relative position thereof may change is not limited to that illustrated in FIG. 2 (*a*). Any other mean may be applied. One example thereof will be described later with referring to FIG. 8.

AS illustrated in the sectional part of the first string shaped member 10*a* in FIG. 2(*a*), a core member 12 which is flexible and may hold a deformed shape is inserted inside the first string shaped member 10*a* which is formed in a hollow cylindrical shape. Similarly, as illustrated in FIG. 2(*b*) which is the sectional view seen from the arrow D of FIG. 2(*a*), the core member 12 which is flexible and may hold a deformed shape is also inserted inside the second string shaped member 10*b* which is formed in a hollow cylindrical shape. Accordingly, the first string shaped member 10*a* and the second string shaped member 10*b* are flexible and may hold a deformed shape.

As a material for the core member 12 which is flexible and may hold a deformed shape, a resin material or a metallic material which may memorize an initial shape may be utilized.

As mentioned above, in this embodiment, since the first string shaped member 10*a* and the second string shaped member 10*b* are flexible and may hold a deformed shape, a position of the string shaped members may be changed according to a growing state of own hairs of a wearer, applications or the like, and further it may hold the changed state. Therefore, it may provide a wig base which a wide range of wearers may use with ease in various applications. Especially, since at the connection part between the first string shaped member 10*a* of the outer frame portion 6 and the second string shaped member 10*b* of the middle portion 8, they are connected in the manner such that a relative position thereof may change, various applications will be expected.

Especially, in this embodiment, as illustrated in FIGS. 2 (*a*), (*b*), the string shaped members 10*a*, 10*b* are formed in a hollow cylindrical shape, and the core member 12 which is flexible and may hold a deformed shape is inserted inside the hollow cylindrical shape, it may easily and surely provide the string shaped members 10*a*, 10*b* which are flexible and may hold a deformed shape.

However, a means to add flexibility and capability to hold a deformed shape to the first string shaped member 10*a* and the second string shaped member 10*b* is not limited to the embodiment as illustrated in FIG. 2 (*a*), and any other means may be applied. For example, when the first string shaped member 10*a* and the second string shaped member 10*b* are formed by winding up a sheet member into a cylindrical shape, it may achieve by using a material which is flexible and may hold a deformed shape. Further, it is possible to add flexibility and capability to hold a deformed shape to the first string shaped member 10*a* and the second string shaped member 10*b* by forming an elongated sheet member or a string shaped member which have flexibility and capability to hold a deformed shape into a spiral shape. In this case, artificial hairs may be tied and planted to the spiral shaped part thereof.

As illustrated in the sectional view of the first string shaped member 10*a* in FIG. 2 (*a*), and the sectional view of the second string shaped member 10*b* in FIG. 2 (*b*), since the hollow cylindrical shape is formed by the net shaped material, the first string shaped member 10*a* and the second string shaped member 10*b* have a net shaped surface in all of the circumference direction thereof. Thus, artificial hairs may be planted to any place of the surface in a circumference direction thereof.

Accordingly, in this embodiment, it may achieve an appropriate arrangement of artificial hairs to obtain a natural appearance of artificial hairs corresponding to a growing state of the own hairs of a wearer, applications or the like. Thus, it may achieve a natural and beautiful hair flow without causing any sense of discomfort to the mixed own hairs.

Further as illustrated in FIG. 1, the second string shaped member 10*b* forming the middle portion 8 and the surface portion 4 are fixed together. In describing in more detail, both ends of the second string shape member 10*b* placed in the waveform are fixed to the surface portion 4, and between the both ends of the second string shaped member 10*b*, the apexes of the waveform located inside are fixed to the surface portion 4. As fixing method of the second string shaped member 10*b* and the surface portion 4, for example, it may be fixed by sewing, by using adhesive agents, or by using a fixing member.

In this embodiment, since the second string shaped member 10*b* forming the middle portion 8 and the surface portion 4 are fixed together, it may provide the wig base 2 and the wig 20 which have a practically sufficient strength.

In this embodiment, while the second string shaped member 10*b* forming the middle portion 8 and the surface portion 4 are fixed together, it is not limited thereto. At least at a part of the second string shaped member 10*b* forming the middle portion 8 and the surface portion 4, they may be connected in the manner such that a relative position thereof may change.

(Description of Wig)

Next, with referring to FIG. 3 to FIG. 5, the wig 20 which is formed by planting artificial hairs to the above-mentioned wig base 2 is further described in detail.

As illustrated in FIG. 4, artificial hairs 14 are planted to one surface of the surface portion 4, and as illustrated in FIG. 5, artificial hairs are planted to a surface of the string shaped members 10*a*, 10*b* forming the outer frame portion 6 and the middle portion 8. Specifically, artificial hairs 14 are planted by tying the artificial hairs 14 to the net shaped surface of the surface portion 4 and the string shaped members 10*a*, 10*b*. Thus, the artificial hairs 14 are wound around a frame member (filament) of the net and tied and fixed thereto. While more detailed description of the tying method is omitted, any tying method may be utilized in this embodiment.

Further, artificial hairs may be planted not only by tying, but also by adhering artificial hairs with coating agents to a sheet shaped member such as an artificial skin in which resin is processed, or by tying the artificial hairs to a hole made on a sheet shaped member. In this embodiment, any known means for planting artificial hairs may be utilized. In FIG. 4 and FIG. 5, a manner such that one artificial hair is planted to one planting place is illustrated, it is not limited thereto. There are cases such that two artificial hairs are planted to one planting place, and more numbers of hairs are planted to one planting place.

As mentioned above, artificial hairs may be planted to any place of the surface in a circumference direction of 360 degrees in the first string shaped member 10*a* and the second string shaped member 10*b* (Refer to FIG. 5). Accordingly, the wig 20 as illustrated in FIG. 3 is formed. In this case, since artificial hairs are planted to the surface portion 4 in high density and artificial hairs are planted only to the string shaped member 10*b* in the middle portion 8, artificial hairs are planted to the middle portion 8 in lower density than the surface portion 4.

Thus, by pulling own hairs 30 out of the places located inside the waveform having apexes located inside or outside as shown by the arrows B, C of FIG. 3, artificial hairs 14 and own hairs 30 are mixed together, and thereby being indistinguishable. Accordingly, it may reduce a sense of discomfort between artificial hairs 14 and own hairs 30, and thereby obtaining more natural appearance. Further, since the wig 20 may be fixed to the head more steadily by pulling own hairs 30 toward the space of the middle portion 8, it may reduce a risk that the wig moves over or slides off.

(Description of Another Embodiments of Wig Base)

Relating to a construction of a connecting part of a first string shaped member 10*a* of an outer frame portion 6 and a second string shaped member 10*b* of a middle portion 8, another embodiment is hereinafter described with referring to FIG. 6 to FIG. 8.

Figure 6:
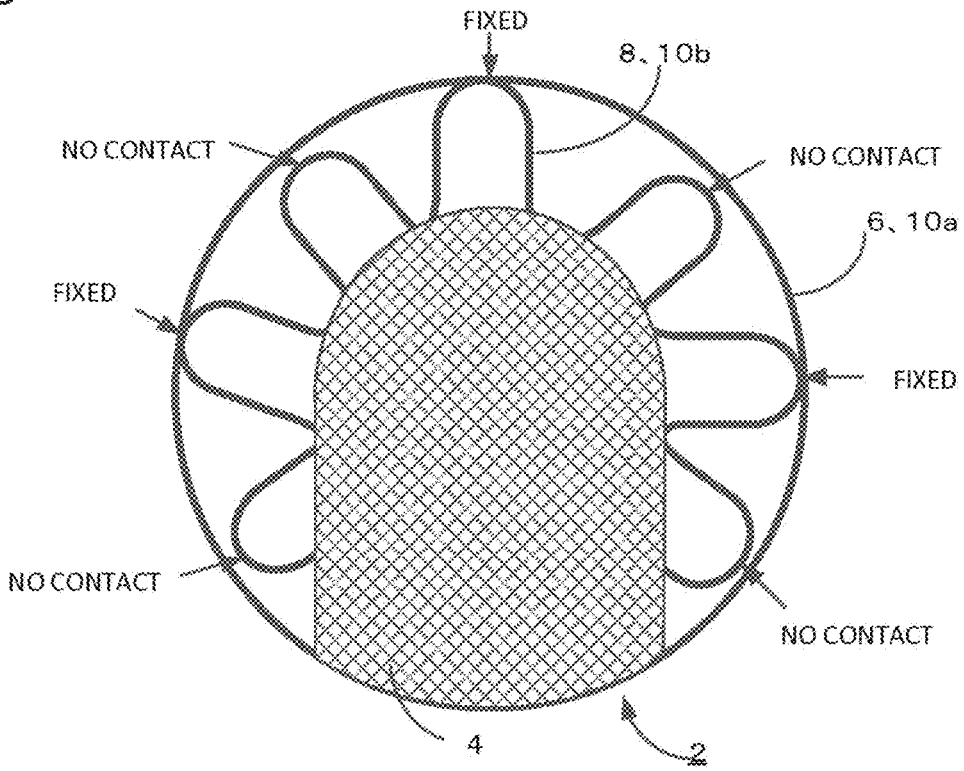
FIG. 6 is a plan view for illustrating a wig base according to another embodiment of the present invention.

<Description of Embodiment Illustrated in FIG. 6>

In a wig base 2 according to the embodiment as illustrated in FIG. 6, a waveform having seven apexes located outside is formed by a second string shaped member 10*b* of a middle portion 8. In the embodiment as illustrated in FIG. 1, in all of the connecting parts of the first string shaped member 10*a* of the outer frame portion 6 and the second string shaped member 10*b* of the middle portion 8, they are connected in the manner such that a relative position thereof may change. However, in this embodiment, every other apexes out of 7 apexes of the waveform are fixed to the first string shaped member 10*a* of the outer frame portion 6, and the other alternate apexes are not connected to the first string shaped member 10*a* of the outer frame portion 6 (no connection).

In this embodiment, at the every other apexes fixed to the first string shaped member 10*a* of the outer frame portion 6, the apexes of the waveform formed by the second string shaped member 10*b* contact the inside of the first string shaped member 10*a* of the outer frame portion 6. However, it is not limited thereto. On the contrary, it is possible that the apexes of the waveform formed by the second string shaped member 10*b* contact the outside of the first string shaped member 10*a* of the outer frame portion 6.

Relating to the fixing method between the apexes of the waveform and the first string shaped member 10*a* of the outer frame portion 6, for example, both may be fixed by sewing, by using adhesive agents or the like, and by using a fixing member.

Further, relating to the fixing method between the apexes of the waveform and the first string shaped member 10*a* of the outer frame portion 6, both may be fixed by inserting a same artificial hair into the opening of the mesh of the net of the second string shaped member 10*b* and into the opening of the mesh of the net of the first string shaped member 10*a*, then tying and fixing the artificial hair.

In this case, since an unnecessary sewing process, an adhesion process, or a surplus fixing member are not required, the apexes of the waveform located outside formed by the second string shaped member 10*b* placed in the waveform in the middle portion 8 and the first string shaped member 10*a* of the outer frame portion 6 may be fixed together efficiently at a low manufacturing cost.

In this embodiment, in the apexes of the waveform not contacting the first string shaped member 10*a* of the outer frame portion 6, the apexes of the waveform formed by the second string shaped member 10*b* and the first string shaped member 10*a* of the outer frame portion 6 are apart from each other. However, it is not limited thereto. It is possible that the apexes of the waveform and the first string shaped member 10*a* contact without connected each other.

In this embodiment, a sufficient rigidity and mechanical strength may be added to the wig 2 by fixing point of the apexes of the waveform located outside formed by the second string shaped member 10*b* of the middle portion 8 and the first string shaped member 10*a* of the outer frame portion 6. At the same time, the second string shaped member 10*b* of the middle portion 8 placed in the waveform and the first string shaped member 10*a* of the outer frame portion 6 may be deformed in any desired shape by the point in which the apexes of the waveform and the first string shaped member 10*a* of the outer frame portion 6 are not connected. Accordingly, it may obtain many variations according to applications, a timing of usage or the like. Further, any appropriate arrangement may be made according to various shapes of the head or a growing state of own hairs.

Figure 7:
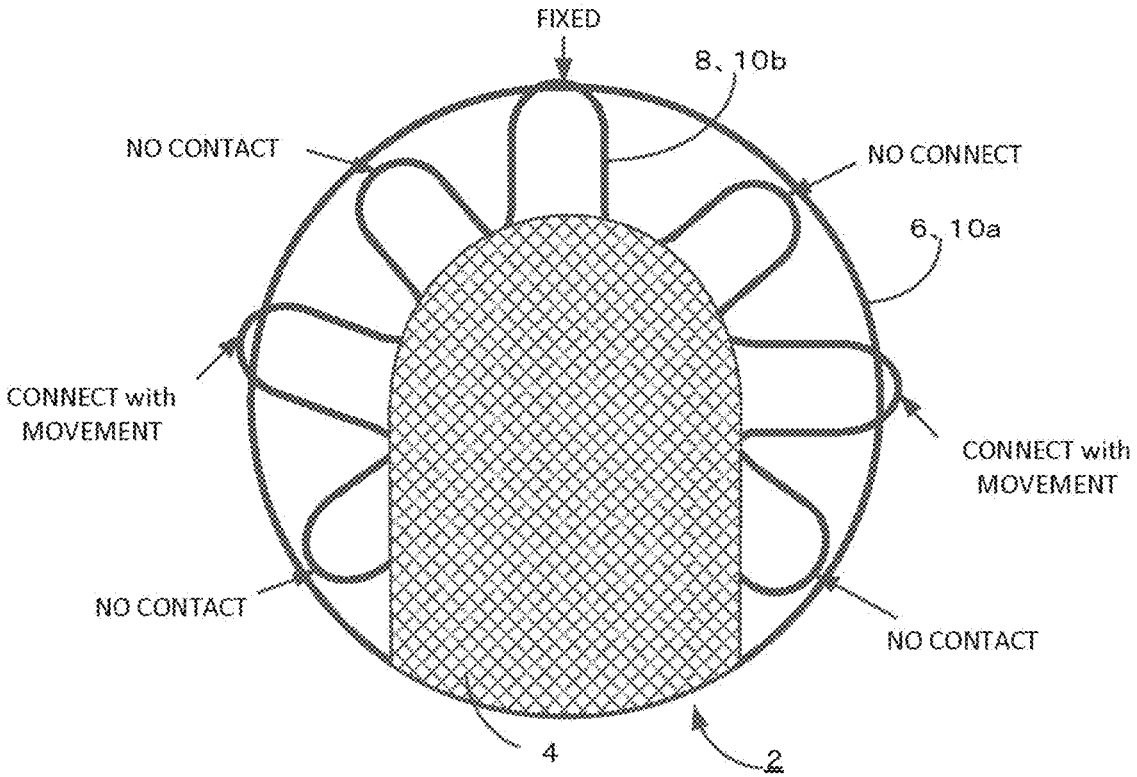
FIG. 7 is a plan view for illustrating a wig base according to another embodiment of the present invention.

<Description of Embodiment Illustrated in FIG. 7>

In a wig base 2 according to the embodiment illustrated in FIG. 7, a waveform having seven apexes located outside is also formed by a second string shaped member 10*b* of a middle portion 8. In the embodiment as illustrated in FIG. 1, in all of the connecting parts of the first string shaped member 10*a* of the outer frame portion 6 and the second string shaped member 10*b* of the middle portion 8, they are connected in the manner such that a relative position thereof may change. However, in this embodiment, in the seven apexes, there are apex of the waveform which is fixed to the first string shaped member 10*a* of the outer frame portion 6, apexes which are not connected to the first string shaped member 10*a* of the outer frame portion 6, and apexes which are connected to the first string shaped member 10*a* of the outer frame portion 6 in the manner such that a relative position thereof may change.

If describing further in more detailed, one apex of the waveform is fixed to the first string shaped member 10*a* of the outer frame portion 6, four apexes of the waveform do not contact the first string shaped member 10*a* of the outer frame portion 6, and two apexes of the waveform connect to the first string shaped member 10*a* of the outer frame portion 6 in the manner such that are relative position thereof may change. The wig base 2 generally has an arrangement in line symmetry. Relating to the fixed point, the no contact point and the connecting point with capability of relative movement between the apexes of the waveform and the first string shaped member 10*a* of the outer frame portion 6, any of the above-mentioned manners may be applied.

Relating to the connecting part between the apexes of the waveform formed by the second string shaped member 10*b* and the first string shaped member 10*a* of the outer frame portion 6, the embodiment as illustrated in FIG. 7 is only one example, and any combination of whole or a part of the fixed point, no contact point and the connecting point with capability of relative movement may be applied.

In this embodiment, only one apex of the waveform formed by the second string shaped member 10*b* of the middle portion 8 is fixed to the first string shaped member 10*a* of the outer frame portion 6. However, since both ends of the first string shaped member 10*a* of the outer frame portion 6 are fixed to the surface portion 4, and further two apexes of the waveform are connected to the first string shaped member 10*a* of the outer frame portion 6 in the manner such that a relative position thereof may change, it may add a sufficient rigidity and mechanical strength to the wig base 2.

In the apex of the waveform connected to the first string shaped member 10*a* of the outer frame portion 6 in the manner such that a relative position thereof may change, it may freely deform the second string shaped member 10*b* of the middle portion 8 placed in the waveform and the first string shaped member 10*a* of the outer frame portion 6. Further, in the apex not connected to the first string shaped member 10*a* of the outer frame portion 6, it may more freely deform the second string shaped member 10*b* of the middle portion 8 placed in the waveform and the first string shaped member 10*a* of the outer frame portion 6. Accordingly, it may correspond to many variations according to applications or a timing. Further, it may make an appropriate arrangement corresponding to various shapes of the head or a growing state of own hairs.

Figure 8:
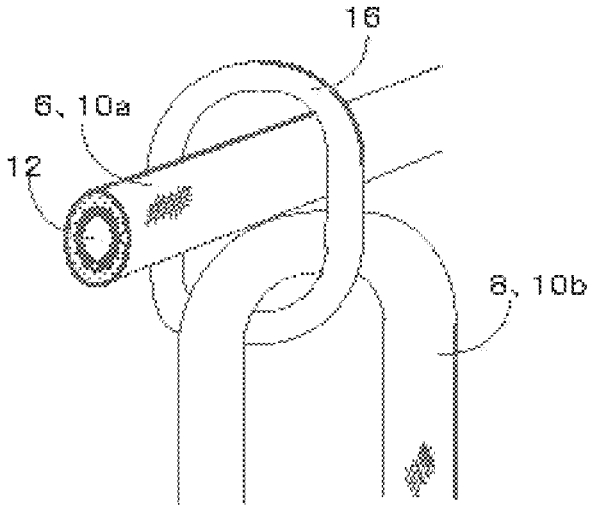
FIG. 8 is a perspective view and a partial sectional view for illustrating a construction of a connecting part of a first string shaped member of an outer frame portion and a second string shaped member of a middle portion according to another embodiment.

<Description of Embodiment Illustrated in FIG. 8>

FIG. 8 illustrates a construction of a connecting part of a first string shaped member 10*a* of an outer frame portion 6 and a second string shaped member 10*b* of a middle portion 8 according to another embodiment, in which the first string shaped member 10*a* and the second string shaped member 10*b* are connected in the manner such that a relative position thereof may change.

In this embodiment, the first string shaped member 10*a* of an outer frame portion 6 and the second string shaped member 10*b* of a middle portion 8 are connected in the manner such that a relative position thereof may change by a ring shaped connecting member 16. For example, the ring shaped connecting member 16 is formed by using a resin material or a metallic material. The ring shaped connecting member 16 may have a cutting. By twisting the ring shaped connecting member 16 elastically to form a clearance at the cutting, and then the first string shaped member 10*a* and the second string shaped member 10*b* may be inserted into the ring shaped connecting member 16 through the clearance. Further, the ring shaped connecting member 16 as illustrated in FIG. 8 may also be formed by tying a string shaped member and forming a ring shape. According to necessity, it may be considered that the ring shaped connecting member 16 has a net shaped surface or a meshwork shaped surface, and artificial hairs are planted to the connecting member 16.

In this embodiment, it is possible to obtain a connection in the manner such that a relative position of the connected members may change at least in a part of the first string shaped member 10*a* of the outer frame portion 6 and the second string shaped member 10*b* of the middle portion 8. Accordingly, it may freely deform the second string shaped member 10*b* of the middle portion 8 and the first string shaped member 10*a* of the outer frame portion 6 and may correspond to many variations according to applications or a timing of usage. It may make an appropriate arrangement corresponding to various shapes of the head or a growing state of own hairs.

The above-mentioned shape of the wig base is only one example. Any numbers of apexes of the waveform may be placed in the middle portion 8, and any shape may be applied to the surface portion 4. Relating to the connecting part of the first string shaped member 10*a* of the outer frame portion 6 and the second string shaped member 10*b* of the middle portion 8, any manners may be applied form from the manners of fixed, no contact and connected with capability of relative movement.

The wig bases having various shapes are included in the embodiment of the present invention. Some examples thereof are described as Example 1 to Example 3. Any one of Example 1 to Example 3 is a wig base for forming a wig by planting artificial hairs thereto, and includes a surface portion having a surface to which artificial hairs may be planted, an outer frame portion in which a first string shaped member to which artificial hairs may be planted is placed outside apart from the surface portion, a middle portion in which a second string shaped member to which artificial hairs may be planted is placed in a waveform between the surface portion and the outer frame portion which are apart from each other. The surface portion and the outer frame portion are connected together via the middle portion.

Description of Example 1

Firstly, a wig base according to Example 1 of the invention is described with referring to FIGS. 9 to 15. In the wig base according to Example 1, a waveform having ten apexes is formed by a second string shaped member in a middle portion. Further, the waveform is formed around the periphery of the surface portion which is connected to the outer frame portion.

Figure 9:
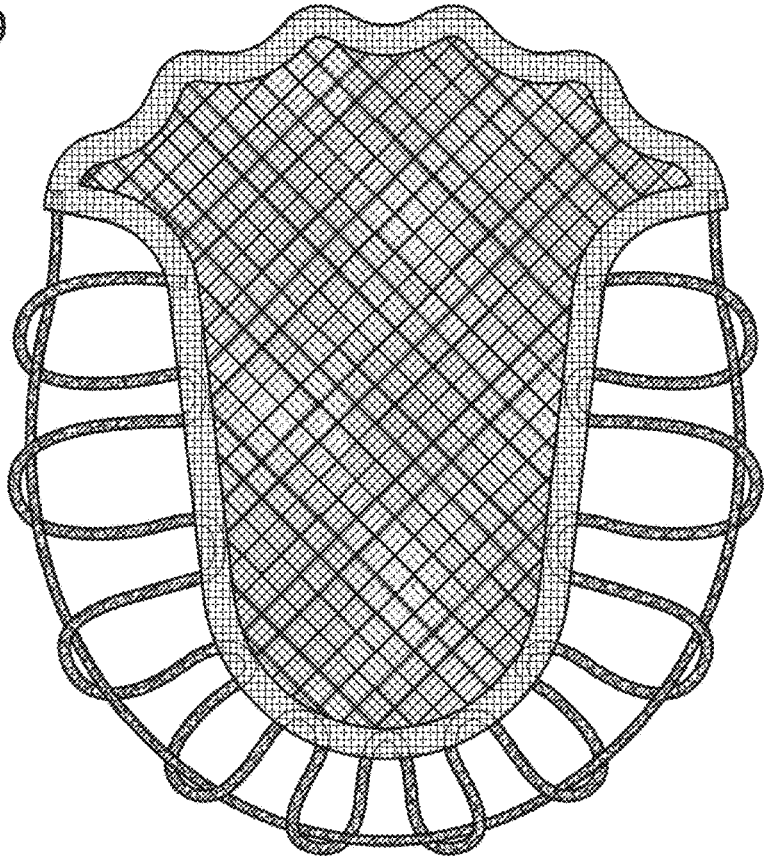
FIG. 9 is a front view for illustrating a wig base according to Example 1 of the present invention.
Figure 10:
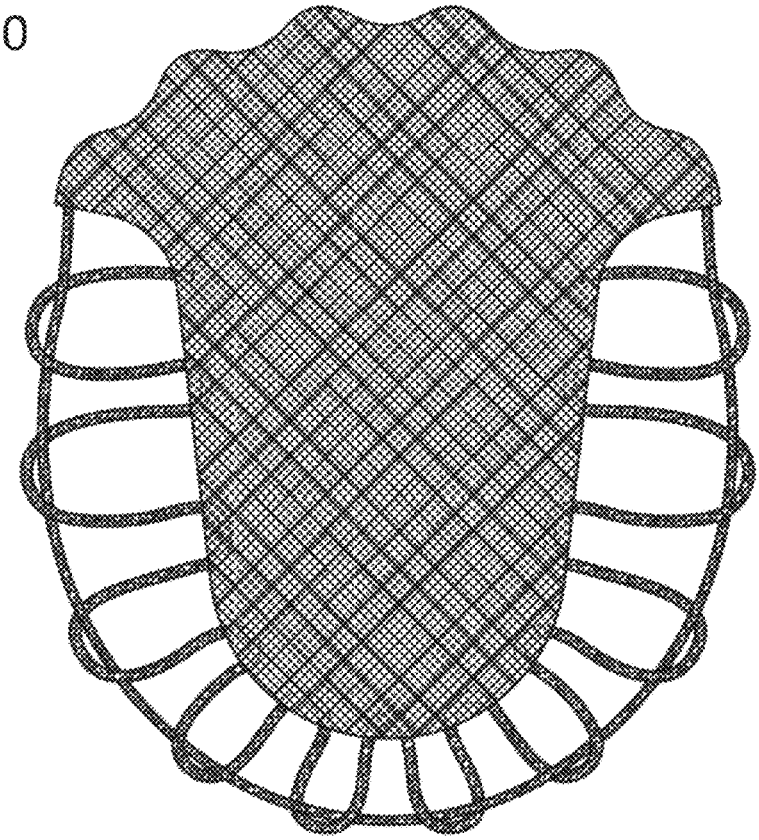
FIG. 10 is a back view for illustrating a wig base according to Example 1 of the present invention.
Figure 12:
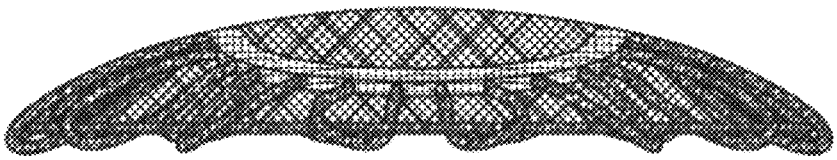
FIG. 12 is a bottom view for illustrating a wig base according to Example 1 of the present invention.
Figure 13:
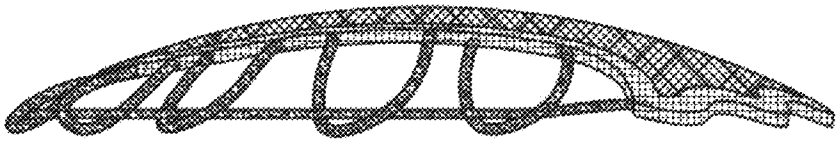
FIG. 13 is a right side view for illustrating a wig base according to Example 1 of the present invention.
Figure 14:
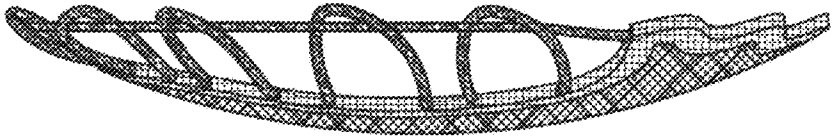
FIG. 14 is a left side view for illustrating a wig base according to Example 1 of the present invention.
Figure 15:
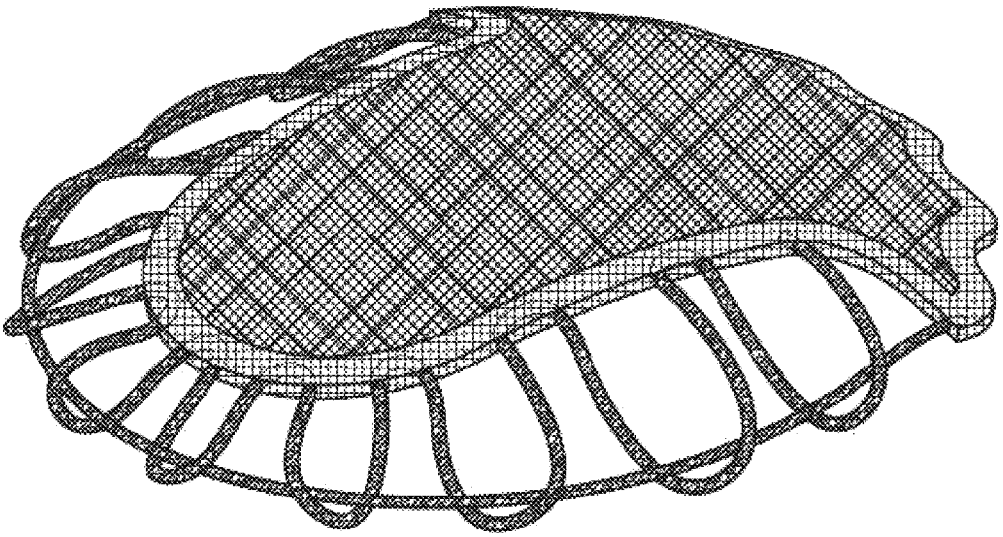
FIG. 15 is a perspective view for illustrating a wig base according to Example 1 of the present invention.

FIG. 9 is a front view for illustrating a wig base according to Example 1 of the present invention, FIG. 10 is a back view, FIG. 11 is a plan view, FIG. 12 is a bottom view, FIG. 13 is a right side view, FIG. 14 is a left side view, and FIG. 15 is a perspective view.

Description of Example 2

Next, a wig base according to Example 2 of the invention is described with referring to FIGS. 16 to 22. In the wig base according to Example 2, a waveform having twelve apexes is formed by a second string shaped member in a middle portion. Further, an approximately circular shape is formed around the periphery of the surface portion which is connected to the outer frame portion.

Figure 16:
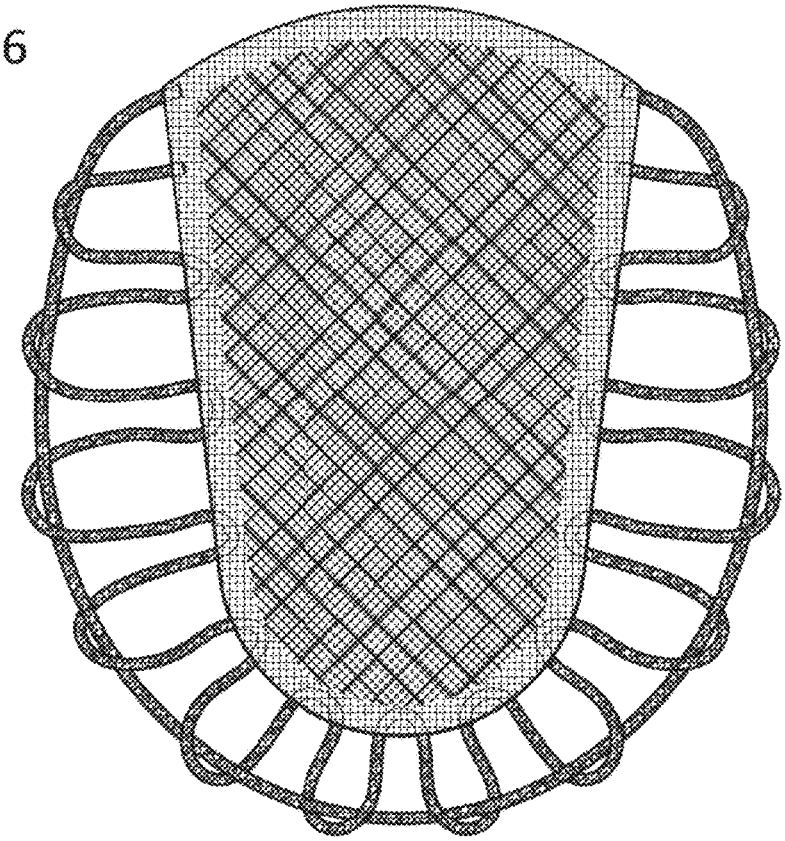
FIG. 16 is a front view for illustrating a wig base according to Example 2 of the present invention.
Figure 17:
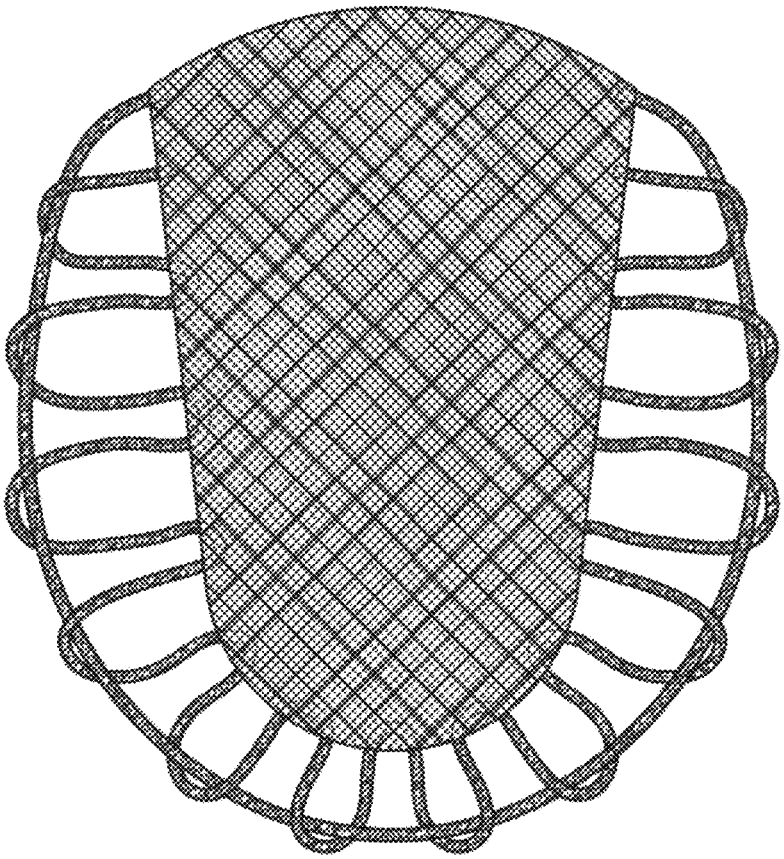
FIG. 17 is a back view for illustrating a wig base according to Example 2 of the present invention.
Figure 18:
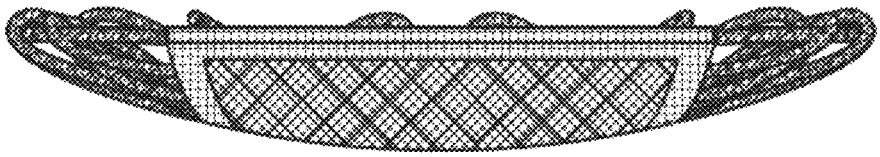
FIG. 18 is a plan view for illustrating a wig base according to Example 2 of the present invention.
Figure 19:
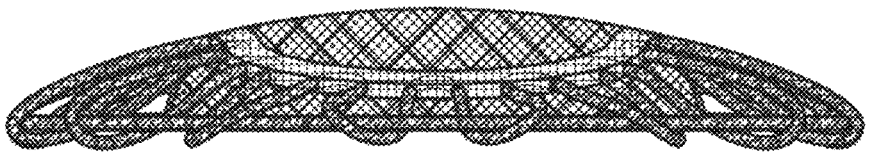
FIG. 19 is a bottom view for illustrating a wig base according to Example 2 of the present invention.
Figure 20:
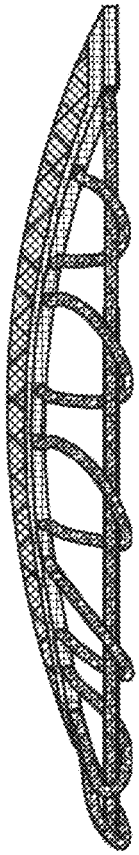
FIG. 20 is a right side view for illustrating a wig base according to Example 2 of the present invention.
Figure 21:
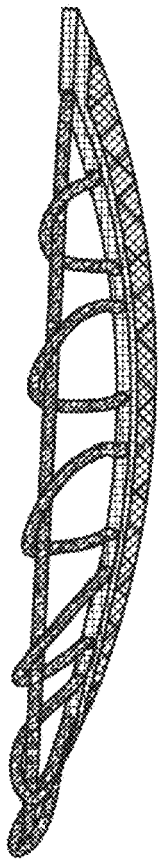
FIG. 21 is a left side view for illustrating a wig base according to Example 2 of the present invention.
Figure 22:
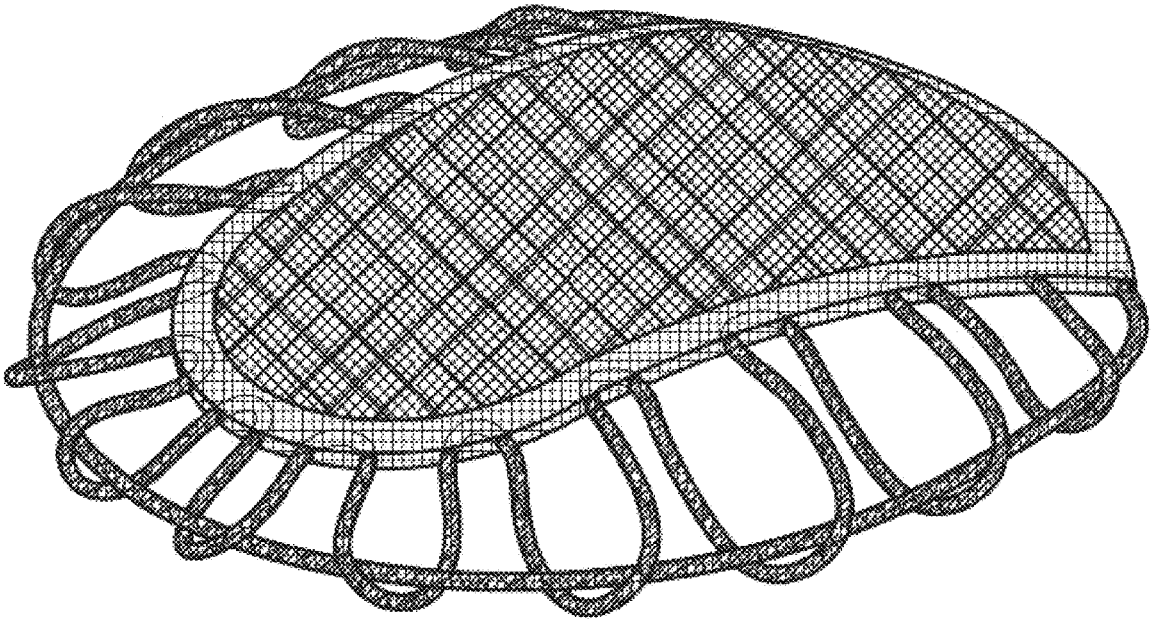
FIG. 22 is a perspective view for illustrating a wig base according to Example 2 of the present invention.

FIG. 16 is a front view for illustrating a wig base according to Example 2 of the present invention, FIG. 17 is a back view, FIG. 18 is a plan view, FIG. 19 is a bottom view, FIG. 20 is a right side view, FIG. 21 is a left side view, and FIG. 22 is a perspective view.

Description of Example 3

Next, a wig base according to Example 3 of the invention is described with referring to FIGS. 23 to 29. In the wig base according to Example 3, a waveform having five apexes is formed by a second string shaped member in a middle portion. Further, the waveform is formed around the periphery of the surface portion which is connected to the outer frame portion.

Figure 23:
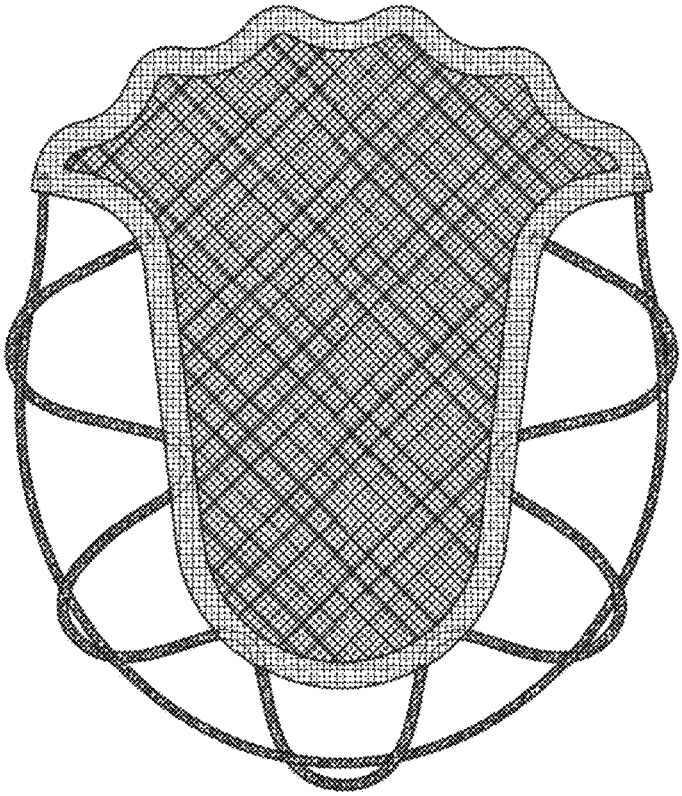
FIG. 23 is a front view for illustrating a wig base according to Example 3 of the present invention.
Figure 24:
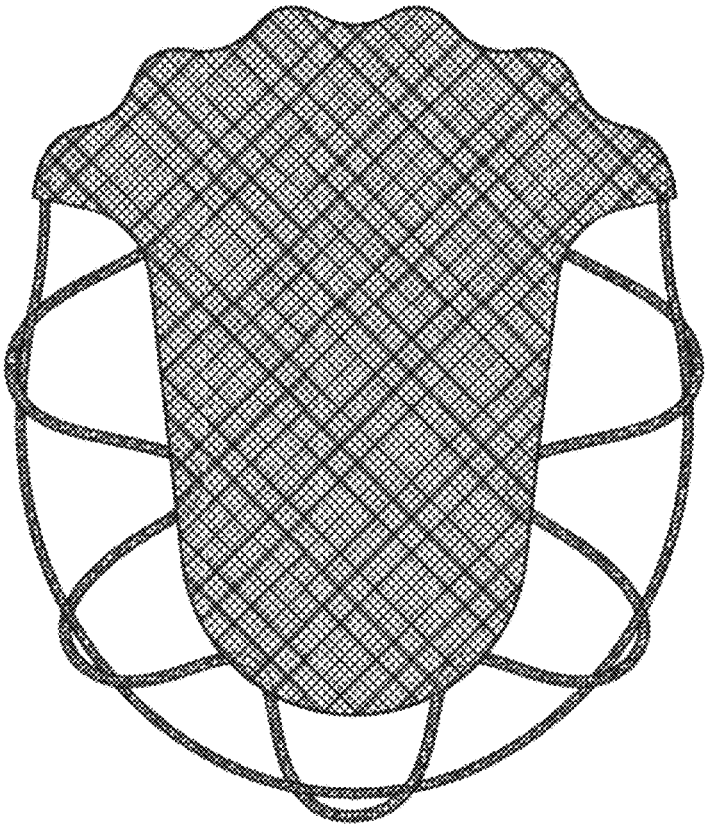
FIG. 24 is a back view for illustrating a wig base according to Example 3 of the present invention.
Figure 25:
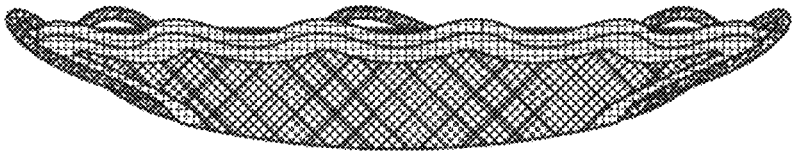
FIG. 25 is a plan view for illustrating a wig base according to Example 3 of the present invention.
Figure 26:
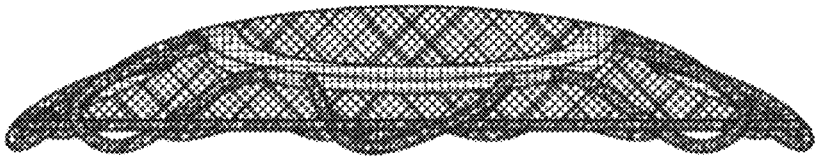
FIG. 26 is a bottom view for illustrating a wig base according to Example 3 of the present invention.
Figure 27:
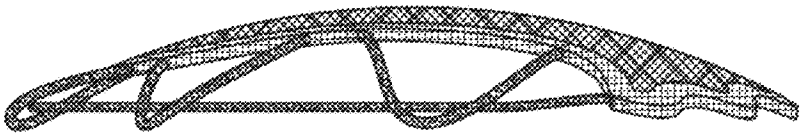
FIG. 27 is a right side view for illustrating a wig base according to Example 3 of the present invention.
Figure 28:
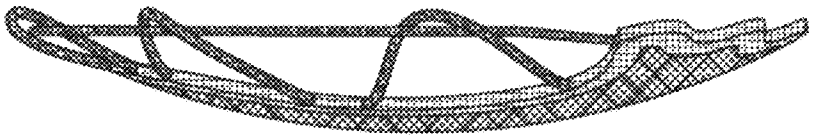
FIG. 28 is a left side view for illustrating a wig base according to Example 3 of the present invention.
Figure 29:
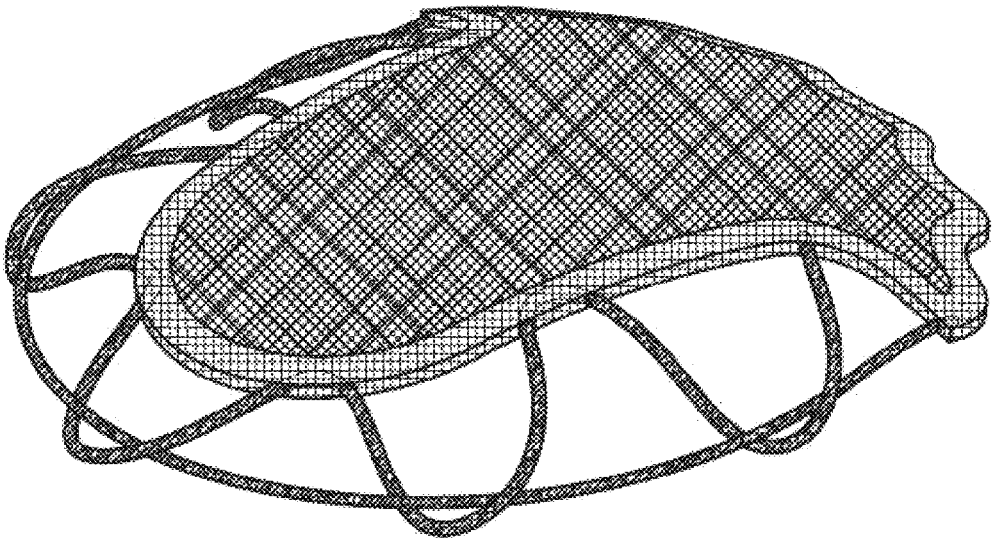
FIG. 29 is a perspective view for illustrating a wig base according to Example 3 of the present invention.

FIG. 23 is a front view for illustrating a wig base according to Example 0.3 of the present invention, FIG. 24 is a back view, FIG. 25 is a plan view, FIG. 26 is a bottom view, FIG. 27 is a right side view, FIG. 28 is a left side view, and FIG. 29 is a perspective view.

While the present invention has been described according to the embodiments, contents of disclosure of the embodiments may be varied in details of the configuration, and the combination of elements and the change of order in the embodiments may be realized without deviating from the scope of the claims and consciousness of the present invention.

DESCRIPTION OF REFERENCE NUMBERS

2 Wig base
4 Surface portion
6 Outer frame portion
8 Middle portion
10*a* First string shaped member
10*b* Second string shaped member
12 Core member
14 Artificial hair
16 Connecting member
20 Wig
30 Own hair

What is claimed is:

1. A wig base comprising:

a surface portion comprising mesh and having opposing first and second sides;

an outer frame portion comprising a first string shaped member extending from the first side of the surface portion in a spaced manner around the surface portion to form a spaced perimeter and connecting to the second side of the surface portion; and a middle portion comprising a second string shaped member extending in a waveform shape between the surface portion and the outer frame portion, the second string shaped member having apexes located along the outer frame portion and troughs located on the surface portion, wherein the troughs of the second string shaped member are fixed to the surface portion, and the apexes of the second string shaped member are connected to the outer frame portion so as to be movable relative to the outer frame portion, and wherein the surface portion, outer frame portion and middle portion are all configured to receive artificial hairs.

2. The wig base according to claim 1, wherein the first string shaped member of the outer frame portion is placed inside the apexes of the second string shaped member at the outer frame portion side.

3. The wig base according to claim 1, wherein the first string shaped member and the second string shaped member are flexible and may hold a deformed shape.

4. The wig base according to claim 3, wherein the first string shaped member and the second string shaped member are formed in a hollow cylindrical shape, and a core member which is flexible and may hold a deformed shape is inserted inside the hollow cylindrical shape.

5. The wig base according to claim 1, wherein artificial hairs may be planted to any place of the surface in a circumference direction of the first string shaped member and the second string shaped member.

6. The wig base according to claim 1, wherein the surface portion, the first string shaped member and the second string shaped portion have a net shaped surface or a meshwork shaped surface.

7. A wig formed by planting artificial hairs to the wig base according to claim 1.

8. The wig according to claim 7, wherein a same artificial hair is planted to the first string shaped member and the second string shaped member, thereby fixing the middle portion and the outer frame portion together.

9. The wig base according to claim 1, wherein the first string shaped member is formed in a circular shape, and the circular shape surrounds at least a portion of a periphery of the surface portion.

10. The wig base according to claim 1, wherein the surface portion is configured to have artificial hairs planted in a higher density as compared to other portions of the wig base.

11. The wig base according to claim 1, wherein both ends of the second string shaped member are fixed to the surface portion.

12. The wig base according to claim 1, wherein the waveform shape of the second string shaped member has a zigzag orientation.

13. The wig base according to claim 1, wherein the apexes of the second string shaped member are each formed by a smooth curve.

* * * * *